United States Patent [19]

Chambley et al.

[11] 4,170,868

[45] * Oct. 16, 1979

[54] YARN FORMING APPARATUS WITH MECHANICAL NODE LOCKING

[75] Inventors: Phillip W. Chambley; Alan H. Norris, both of Rome, Ga.

[73] Assignee: WWG Industries, Inc., Rome, Ga.

[ * ] Notice: The portion of the term of this patent subsequent to Feb. 21, 1995, has been disclaimed.

[21] Appl. No.: 875,091

[22] Filed: Feb. 6, 1978

Related U.S. Application Data

[63] Continuation-in-part of Ser. No. 755,671, Dec. 30, 1976, Pat. No. 4,074,511.

[51] Int. Cl.[2] ..... H01B 13/04; D02G 3/26

[52] U.S. Cl. ..... 57/293; 28/103; 28/107; 28/139

[58] Field of Search ..... 57/34 AT, 34 R, 22, 57/293; 28/103, 116, 139, 107

[56] References Cited

U.S. PATENT DOCUMENTS

| | | | |
|---|---|---|---|
| 124,828 | 3/1872 | Ladd | 28/139 |
| 1,002,177 | 8/1911 | Reynolds | 28/139 X |
| 3,434,275 | 3/1969 | Barker et al. | 57/34 AT |
| 3,775,955 | 12/1973 | Shah | 57/34 AT |
| 4,074,511 | 2/1978 | Chambley et al. | 57/34 AT |

*Primary Examiner*—Charles Gorenstein

*Attorney, Agent, or Firm*—Beveridge, DeGrandi, Kline & Lunsford

[57] ABSTRACT

False-twisted yarn strands are separately carried around a guide wheel and the nodes thereof are brought together and locked by mechanical entanglement, after which the strands are self-twisted. Embodiments of entanglement joining devices include reciprocating friction plates which rub the fibers together and twist them, causing joining, the plates being carried on the guide wheel. A needle punching device carried by the wheel is disclosed, the needles being reciprocated by a cam structure within the wheel. In a third embodiment edges of oppositely rotating overlapping discs contact and twist fibers in the node area, causing entanglement.

9 Claims, 12 Drawing Figures

YARN FORMING APPARATUS WITH MECHANICAL NODE LOCKING

This is a continuation-in-part of U.S. patent application Ser. No. 755,671, filed Dec. 30, 1976, now U.S. Pat. No. 4,074,511.

This invention relates to apparatus for joining multiple yarn strands and, more specifically, to apparatus for joining together the nodes of self-twisted yarn strands.

BACKGROUND OF THE INVENTION

In our U.S. Pat. No. 4,074,511, which is incorporated herein by reference, there is disclosed a system for forming self-twist, false-twist yarn strands. It was pointed out therein that it is highly desirable to join false-twisted yarn strands at their nodes before permitting the strands to ply together because the resulting product is more stable and its characteristics are more reliably predictable.

To accomplish that goal, the system provided a rotatable guide member in the form of a yarn wheel having circularly extending guide flanges defining guide paths therebetween. At least three such flanges are provided to define separated guide paths for at least two yarns, although multiple flanges can be used for multiple yarns, the number of flanges always being one more than the number of yarns.

The inner separatory flange or flanges are interrupted at at least one location to permit the guide paths to merge so that the yarn strands therein can be brought together and joined or locked together. The joined strands then leave the yarn wheel and are permitted to self-twist, forming a plied yarn.

The locking means disclosed in that application comprises a rotating disc, the surface of which is exposed to the strands at the interruption location. The disc rotates at a relatively high speed, engaging and entangling the fibers of the yarn strands to accomplish the locking. The disc is driven by a motor carried in the rotating yarn wheel. Two or more motor and disc arrangements can be provided and located such that the circumferentail distance between discs is equal to the spacing between nodes. It will be recognized that the yarn wheel rotation speed is synchronized with the longitudinal speed of the yarn so that there is substantially no longitudinal movement of the yarn relative to the guide surfaces on which they lie.

While this arrangement is quite suitable for spun yarns of carded staple fiber, its effect is somewhat reduced in the processing of bulked continuous filament yarns. This is due to the availability of many free ends of fibers to be intertwined together in the spun yarn, whereas the continuous filament yarn has no free fiber ends available for twisting together and locking the node. There is consequently a need for mechanisms that will join and lock nodes of self twist yarns of either the spun staple or continuous filament variety.

BRIEF DESCRIPTION OF THE INVENTION

Accordingly, the present invention provides alternative and improved apparatus for joining yarn strands, particularly separately carried strands on a rotating guide member, by mechanically entangling fibers of the strands together.

Briefly described, the invention includes an improved apparatus for joining synthetic yarn strands in a machine of the type having means for forming at least two singles yarn strands, means for twisting each of the strands individually to form false-twisted strands, each having longitudinally spaced nodes at which the direction of twist reverses, rotatable guide means having a central axis and a peripheral surface for guiding and carrying said strands into spaced substantially parallel paths with the nodes of the strands substantially aligned with each other, means at a predetermined location on said guide means for bringing the nodes of the strands into contact with each other, and means for joining the strands to each other at the nodes, the improvement wherein the means for joining comprises means for mechanically entangling the fibers of the yarn strands at the nodes to lock the nodes to each other.

In order that the manner in which the various objects are attained in accordance with the invention can be understood in detail, particularly advantageous embodiments thereof will be described with reference to the accompanying drawings, which form a part of this specification, and wherein.

Figure 1:
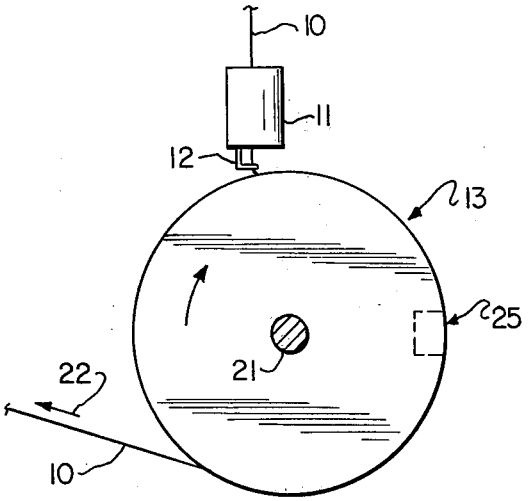
FIG. 1 is a side elevation of a yarn guide wheel showing the general location of joining devices in accordance with the present invention.
Figure 2:
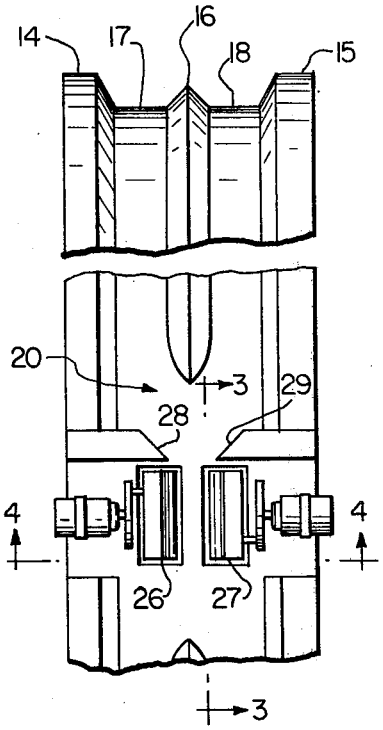
FIG. 2 is an enlarged partial plan view of an entangling apparatus in accordance with the invention.

The general arrangement of the yarn wheel is shown in FIG. 1 wherein a plurality of yarns 10 are delivered to a plurality of twist jet devices 11, one yarn and one such jet device being visible in FIG. 1. In the jet-twist devices, the yarns are false twisted and are passed through wire guides 12 from which they are placed on the guide surfaces of a yarn guide wheel indicated generally at 13. As described in copending application Ser. No. 755,671 now U.S. Pat. No. 4,074,511, and as also seen in FIG. 2, the guide wheel is provided with outer flanges 14 and 15 and a central separatory flange 16 defining peripheral guide surfaces 17 and 18 which receive the yarn strands, flange 16 functioning to keep the yarns separated over most of the yarn length passing around the wheel. Flange 16 is interrupted at 20 to provide a region wherein the yarns can be brought toward each other for purposes of locking the yarns together. The wheel is rotatably driven about the central axis of an axle 21 by drive means, not shown, at a speed which substantially matches the travelling speed of the yarns so that there is little or no relative movement between the yarns and the wheel. Furthermore, the movements are synchronized so that the portion of each yarn strand which lies adjacent interruption 20 constitutes the nodes, or points of twist reversal, of the yarns. Thus, the nodes of the yarns can be joined together as the wheel rotates. Then, when the yarns are removed from the wheel, moving in the direction of arrow 22, they are permitted to self-twist together, forming a continuous stable self-twisted strand.

The subject matter of the present invention relates to devices for accomplishing the node joining, and apparatus for performing this function is supplied at a predetermined location on the yarn guide wheel indicated in FIG. 1 at 25. In each of the embodiments discussed herein with reference to FIGS. 2–12, the devices described will be assumed to be located at location 25, and no further description or discussion of the twist jets and related subject matter will be made in connection with these individual embodiments.

A joining device using mechanical rubbing friction to accomplish node locking is shown in FIGS. 2–5 and includes a pair of friction plates 26 and 27 which have inwardly facing surfaces directed toward each other to engage the yarn. It will be recognized that the yarn strands having generally been omitted from the figures so as not to obscure the apparatus itself, but that the strands would extend along guide paths 17 and 18 and are guided toward the center of interruption 20 by beveled guide surfaces 28 and 29 so as to pass between plates 26 and 27.

Figure 3:
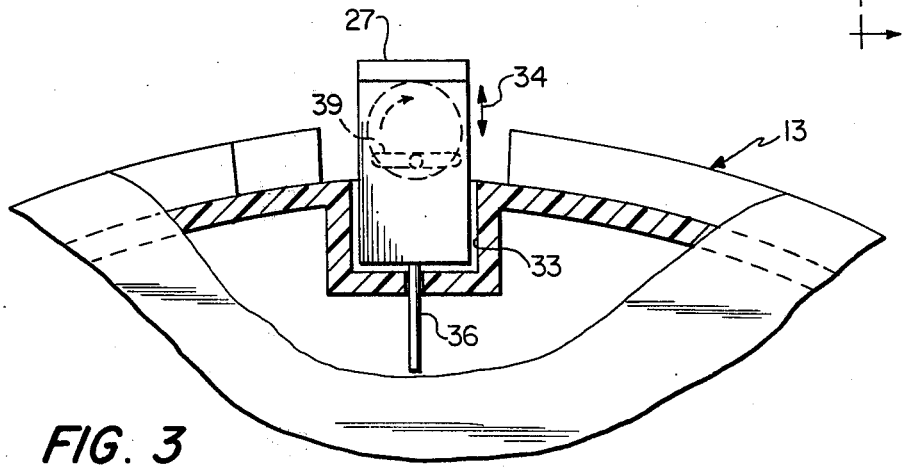
FIG. 3 is an enlarged partial side elevation, in partial section, of the apparatus of FIG. 2.
Figure 4:
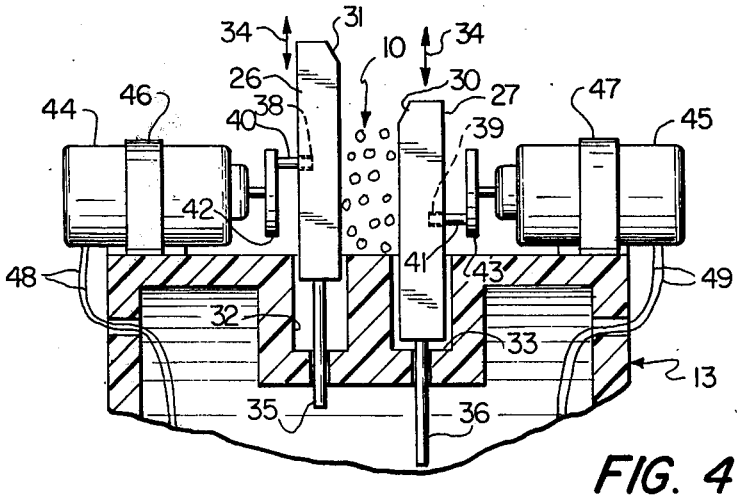
FIG. 4 is a front elevation of the apparatus of FIGS. 2 and 3.
Figure 5:
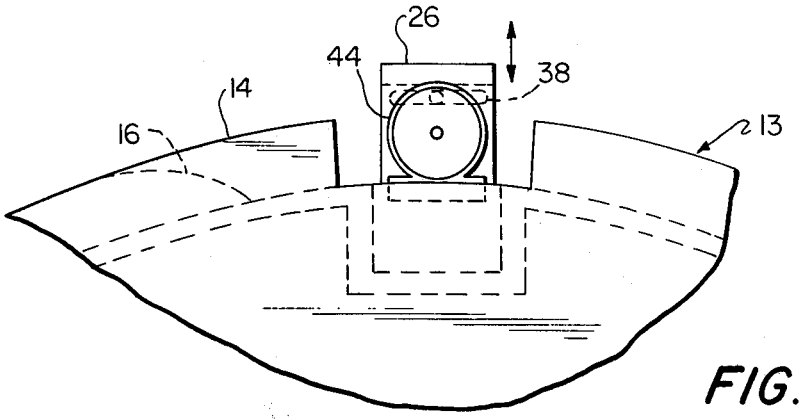
FIG. 5 is an enlarged partial side elevation of the apparatus of FIGS. 2–4 in accordance with the invention.

As seen in FIGS. 3 and 4, plates 26 and 27 are generally rectangular in shape and have beveled upper surfaces 30 and 31 to promote entry of the yarn between the plates. Yarn wheel 13 can be formed of molded plastic and is provided with radially inwardly extending recesses 32 and 33 to receive the lower portions of the plates, the recesses being generally rectangular and shaped to rather closely surround the plates to guide their motion and to permit them to reciprocate radially with respect to the central axis of axle 21 as indicated by arrows 34. As an additional guide, each plate can be provided with a downwardly extending rod 35 and 36 which passes through a circular opening in the bottom of the recess, the rod acting simply as a guide rod.

The outer surfaces of plates 26 and 27 are provided with transversely extending elongated slots 38 and 39 which receive pins 40 and 41, respectively, attached to discs 42 and 43. The discs are mounted, at their centers, on the output shafts of motors 44 and 45 which are fixedly attached to the outer portions of wheel 13 by any convenient mounting device such as holding straps 46 and 47. Electrical conductors 48 and 49 provide electrical power to the motors through any convenient conventional means such as slip rings mounted on axle 21.

As will be recognized, the pins 40, 41 and discs 42, 43 form eccentric drive devices, the pins being capable of laterally moving in slots 38 and 39 and driving the plates up and down to provide a motion which is alternating and reciprocating. When the yarn strands 10 are placed between these reciprocating plates, the radial rubbing action of these plates on the fibers of the strands causes the individual fibers to be twisted and thereby entangled with each other. The rubbing process begins when location 25 receives the yarns from wire guides 12, and continues until the yarns are removed approximately one-half revolution of the yarn guide wheel away from the receiving point. Thus, the rapidly reciprocating plates have ample opportunity to rub and twist the fibers and to cause them to firmly entangle with each other, securely locking the nodes. It is significant to note that the plates are arranged so that they are always moving in directions opposite from each other, and, if desired, or necessary, a rocking member, centrally pivoted, and connected to the lower ends of rods 35 and 36 can be provided in the yarn wheel structure to guarantee that the plates always have this relative phase relationship. With this motion, a false twist at the node itself is inserted into the individual fibers, thereby permitting a self-twist entanglement to occur at the node only. This should not be confused with the false twist imparted to the strands by the jet devices, which latter twist is accomplished with respect to the entire strand and not to the individual fibers thereof.

Figure 6:
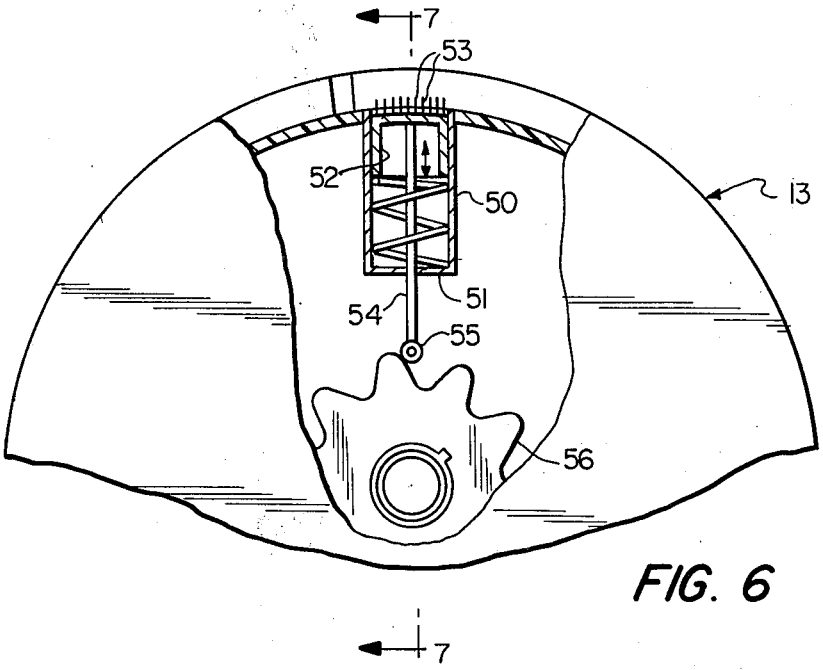
FIG. 6 is a partial side elevation, in partial section, of a further embodiment of a joining apparatus according to the invention.
Figure 7:
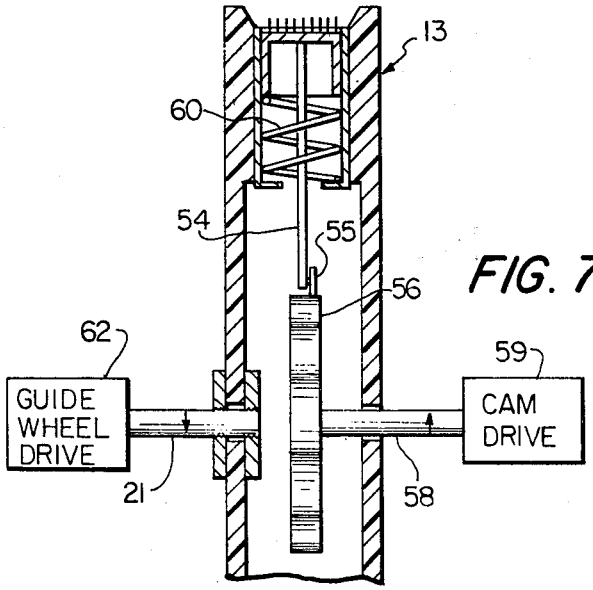
FIG. 7 is a partial front elevation, in partial section, along lines 7—7 of FIG. 6.
Figure 8:
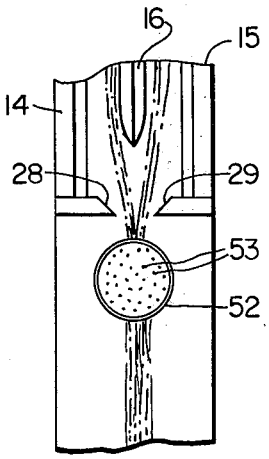
FIG. 8 is a partial plan view of the embodiment of FIGS. 6 and 7.
Figure 9:
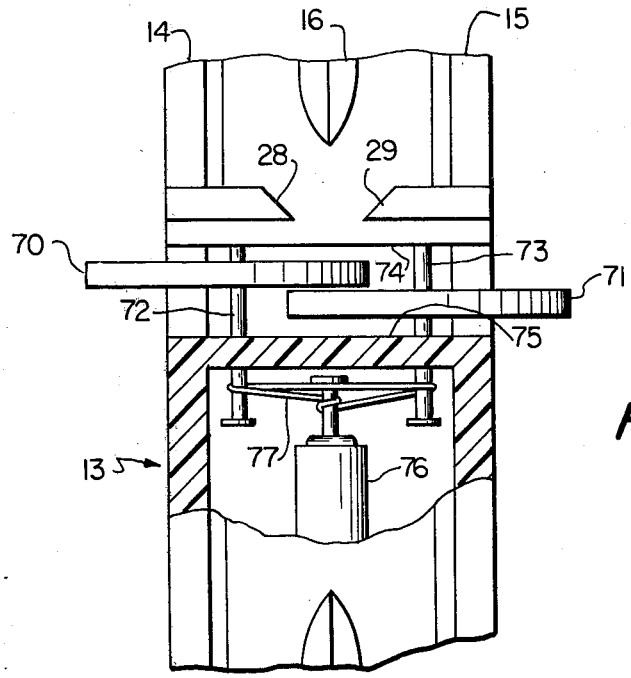
FIG. 9 is a partial plan view, in partial section, of a third embodiment of a joining apparatus in accordance with the invention.
Figure 10:
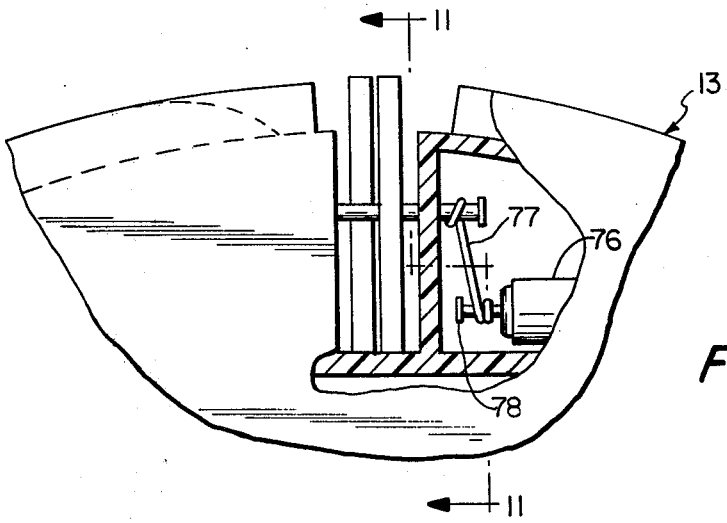
FIG. 10 is a partial side elevation, in partial section, of the embodiment of FIG. 9.
Figure 11:
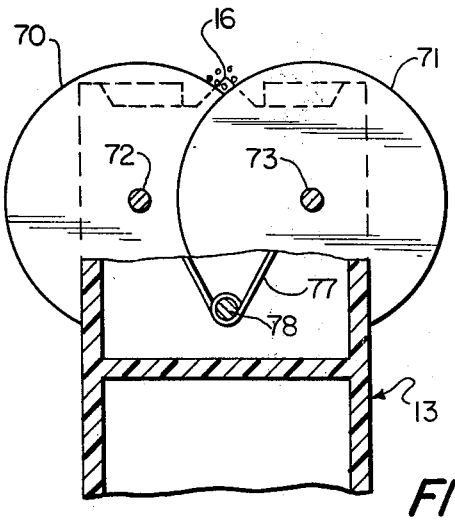
FIG. 11 is a partial front elevation, in partial section, of the embodiment of FIGS. 9 and 10.

Another embodiment of an entanglement device to lock the nodes and which can be provided at location 25 is shown in FIGS. 6–8. In this embodiment yarn wheel 13 is provided with a radially inwardly extending sleeve 50, the outer end of which is at the surface which is coextensive with the peripheral guide surfaces 17 and 18 and at interruption 20. At the inner end of sleeve 50 is a transverse wall 51 having a central opening. Within sleeve 50 is a cup-shaped piston member 52 having an end wall provided with a plurality of protruding needles which are fixedly attached to the outer surface of piston 52 and which protrude radially, generally parallel with each other. A connecting rod 54 is attached to the inner surface of the piston and passes through the central opening in end wall 51, the lower or inner end of the connecting rod being attached to a rotatable cam follower 55 which is in the form of a small wheel. Follower 55 rides on the convoluted surface of a gear-like cam member 56 which at least partially surrounds the central axis of wheel 13. It will be observed, as best seen in FIG. 7, that cam 56 is not directly attached to wheel 13. Instead, cam 56 is supported on a separate shaft 58 which can either be fixedly mounted or attached to a separate cam drive 59. It will also be observed that an extension coil spring 60 is provided within sleeve 50 between end wall 51 and the lower margin of piston 52, spring 60 being attached at both of its ends so that it tends to urge piston 52 downwardly or radially inwardly with respect to the wheel.

As best seen in FIG. 8, the yarns 10 are guided toward each other by surfaces 28 and 29, as before, at the location at which flange 16 is interrupted, the yarns thus being caused to merge and pass together over the region in which they are exposed to the outer surface of piston 52 and needles 53. As the wheel rotates relative to cam 56, follower 55 rides up and down, or in and out, on the convolutions of the outer surface of the cam, causing the piston to move radially inwardly and outwardly between a position in which the outer surface of the piston is substantially coextensive with the periphery of the wheel and an inner position in which the needles are withdrawn into sleeve 50. This causes the needles to repeatedly puncture the yarn strands, an action which tends to intermingle and entangle the fibers thereof. It has been found that repeated puncturing with needles in this fashion pushes and pulls the various fibers in a way which causes them to become entangled and locked together.

It is desirable for this repeated puncturing to be relatively rapid and to occur numerous times at a node as it passes around the wheel and before it is removed there-from. Thus, it is desirable to provide a cam drive 59 which rotates shaft 58 in the opposite direction from the rotation of shaft 21 as accomplished by a guide wheel drive indicated in FIG. 7 as a block 62. By rotating the cam in the opposite direction from the wheel, the frequency of reciprocation of piston 52 and needles 53 is greatly increased and the effectiveness and completeness of the entanglement is thereby enhanced. The number of times is, of course, proportional to the number of lobes on the cam, the angular extent of wheel 13 over which the yarn is permitted to pass, and the relative speeds of rotation of wheel 13 and cam 56.

Figure 12:
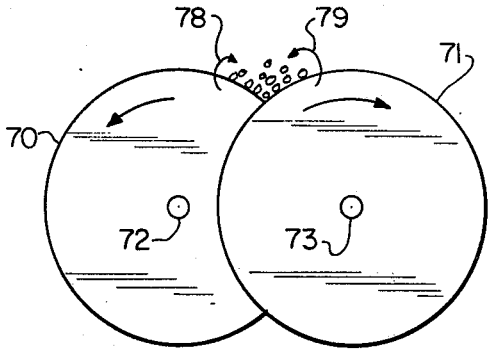
FIG. 12 is a schematic illustration of the manner of operation of the embodiment of FIGS. 9–11.

A further embodiment of a mechanical entangling device is shown in FIGS. 9–12 to include a pair of discs 70 and 71 which have substantially flat outer annular surfaces. The discs are mounted on axles 72 and 73, respectively, which are supported in transverse wall portions 74 and 75 of a recess in wheel 13. Axles 72 and 73 are free to rotate, the discs being rigidly attached to the axles and therefore being free to rotate with the axles. A drive motor 76 is mounted within a cavity in wheel 13 and is coupled to axles 72 and 73 by an endless belt 77 which is caused to pass around the output shaft 78 and a portion of each of axles 72 and 73, the output shaft and the axles each being provided with enlarged ends to prevent the belt from slipping off. It will be observed that the belt, which can be in the nature of a rubber band, is caused to pass around these axles so that they, and the discs carried with them, rotate in opposite directions. It will also be observed that the axles themselves are mounted in wheel 13 in parallel spaced relationship, the spacing therebetween being greater than the radius of either disc and less than the diameter of either disc so that the discs overlap and thereby define a point of overlap which lies substantially in the same plane as the adjacent surface portions of the guide wheel guide surface periphery. Thus, the yarns extending along the guide surfaces on opposite sides of flange 16, and which are brought together by surfaces 28 and 29 are caused to lie across the discs at the point of overlap. As best seen in FIG. 12, as the discs rotate, the surface portions thereof nearest the point of overlap are moving away from each other and, by frictional engagement with the fibers of the strands, tend to rotate the fibers in the directions shown by arrows 78 and 79, causing the fibers to be intertwined with each other and sufficiently entangled to firmly lock the node together. The speed of motor 76 and, therefore, of discs 70 and 71 can be chosen sufficiently high to cause entanglement and complete locking during that interval in which the node lies across the interrupted portion of flange 16 as the yarn travels from the point of reception to the point of departure to and from the yarn guide wheel. As before, the yarn is then removed and permitted to self-twist.

While certain advantageous embodiments have been chosen to illustrate the invention, it will be understood by those skilled in the art that various changes and modifications can be made therein without departing from the scope of the invention as defined in the appended claims.

What is claimed is:

1. An improved apparatus for joining synthetic yarn strands in a machine of the type having means for forming at least two singles yarn strands, means for twisting each of said strands individually to form false-twisted strands, each having longitudinally spaced nodes at which the direction of twist reverses, rotatable guide means having a central axis and a peripheral surface for guiding and carrying said strands into spaced substantially parallel paths with the nodes of said strands substantially aligned with each other, means at a predetermined location on said guide means for bringing the nodes of said strands into contact with each other, and means for joining said strands to each other at the nodes, the improvement wherein said means for joining comprises means for engaging and mechanically entangling the fibers of the yarn strands at the nodes to lock the nodes to each other.

2. An apparatus according to claim 1 wherein said means on said rotatable guide means for bringing said strands into contact with each other includes guide surface means adjacent said peripheral surface for urging said strands together axially relative to the axis of rotation of said rotatable guide means.

3. An apparatus according to claim 2 wherein said means for engaging and entangling includes first and second friction plates having planar yarn contacting surfaces;

means in said rotatable guide means for supporting said friction plates with said planar surfaces in parallel spaced relationship facing each other and for guiding said plates to permit radial movement thereof relative to said central axis;

drive means carried by said rotatable guide means and coupled to said plates for repeatedly moving said plates radially, said guide surface means being located to guide said yarn strands between said plates so that repeated motion thereof entangles the strand fibers and causes joining thereof.

4. An apparatus according to claim 3 wherein said drive means includes first and second motors, one operatively associated with each of said plates; and eccentric means coupling said motors to said plates.

5. An apparatus according to claim 2 wherein said means for engaging and entangling includes a mounting plate;

a plurality of needles mounted on and protruding from an exposed surface of said plate;

means in said rotatable guide means for supporting and guiding said exposed surface substantially parallel with said peripheral surface adjacent said guide surface means and along the path of the yarn strands, said plate being radially movable relative to said central axis; and means in said rotatable guide means and coupled to said mounting plate for reciprocating said plate between a position of substantial alignment with said peripheral surface and a position radially inwardly of said peripheral surface, whereby said needles are caused to repeatedly penetrate said strands and entangle the fibers thereof.

6. An apparatus according to claim 5 wherein said means for reciprocating includes a cam member having a cam surface with radially varying convolutions;

a cam follower riding on said cam surface;

a connecting rod interconnecting said follower and said mounting plate; and means for supporting said cam member so that said rotatable guide member rotates relative thereto.

7. An apparatus according to claim 6 wherein said means for supporting said cam member includes means for rotating said cam member in a direction opposite the direction of rotation of said rotatable guide member.

8. An apparatus according to claim 2 wherein said means for engaging and entangling includes first and second friction discs of substantially equal diameter having annular surfaces for engaging the yarn strands;

first and second axles, one of said axles passing through and attached to each of said discs;

means in said rotatable guide means for receiving said discs and for supporting said axles in parallel spaced relationship so that said discs are adjacent each other and lie substantially in planes containing said central axis, the spacing between said axles being greater than a disc radius and significantly less than a disc diameter so that said annular surfaces thereof have a point of overlap near said peripheral surface, said guide surface means being operative to guide the yarn strands into engagement with said annular surfaces near said point of overlap; and drive means coupled to said axles for driving said discs in opposite directions so that points on said annular surfaces move away from said point of overlap whereby the fibers of said strands are entangled by said discs and joined together.

9. An apparatus according to claim 8 wherein said drive means includes a drive motor mounted in said rotatable guide means and having an output shaft; and an endless belt extending around said output shaft and said axles.

* * * * *